US008457508B2

(12) United States Patent
Nishimura

(10) Patent No.: US 8,457,508 B2
(45) Date of Patent: Jun. 4, 2013

(54) DEVELOPING BIAS SETTING IN AN IMAGE FORMING APPARATUS

(75) Inventor: Yoh Nishimura, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 700 days.

(21) Appl. No.: 12/647,082

(22) Filed: Dec. 24, 2009

(65) Prior Publication Data

US 2010/0166440 A1 Jul. 1, 2010

(30) Foreign Application Priority Data

Dec. 26, 2008 (JP) ..... 2008-334378

(51) Int. Cl.
*G03G 15/06* (2006.01)
*G03G 15/08* (2006.01)
*G03G 15/10* (2006.01)

(52) U.S. Cl.
USPC ..... 399/29; 399/55; 399/60; 399/61

(58) Field of Classification Search
USPC ..... 399/29, 53, 55, 60, 61
See application file for complete search history.

(56) References Cited

U.S. PATENT DOCUMENTS

| | | | | |
|---|---|---|---|---|
| 5,950,043 | A * | 9/1999 | Fujita et al. | 399/60 |
| 6,324,354 | B1 * | 11/2001 | Tode et al. | 399/29 |
| 7,095,964 | B2 * | 8/2006 | Koyama et al. | 399/24 |
| 2004/0105689 | A1 * | 6/2004 | Shimura et al. | 399/12 |
| 2006/0039709 | A1 * | 2/2006 | Odani | 399/27 |
| 2006/0051106 | A1 * | 3/2006 | Takahashi et al. | 399/12 |
| 2006/0056867 | A1 * | 3/2006 | Taguchi | 399/49 |
| 2006/0204257 | A1 * | 9/2006 | Kawano et al. | 399/27 |
| 2010/0166439 | A1 * | 7/2010 | Nishimura | 399/29 |

FOREIGN PATENT DOCUMENTS

| | | | |
|---|---|---|---|
| JP | 2003-202773 | A | 7/2003 |
| JP | 2004-177928 | | 6/2004 |
| JP | 2004-233436 | A | 8/2004 |
| JP | 2005-227730 | A | 8/2005 |

OTHER PUBLICATIONS

Notification of Reason for Refusal dated Jan. 18, 2011 in Japanese Application No. 2008-334378 and English translation thereof.

* cited by examiner

*Primary Examiner* — Walter L Lindsay, Jr.
*Assistant Examiner* — David Bolduc
(74) *Attorney, Agent, or Firm* — Banner & Witcoff, Ltd.

(57) ABSTRACT

An image forming apparatus includes: an image carrier; a developing housing that accommodates a developer for developing an electrostatic latent image into a developer image; a developer carrier, which carries the developer in the developing housing, and which supplies the developer to the image carrier; a developing bias supply part that supplies a developing bias to the developer carrier; a remaining quantity calculation part that calculates a remaining quantity of the developer in the developing housing; a deterioration grade storage part that stores a relationship between the remaining quantity of the developer in the developing housing and a deterioration degree of the developer caused by the developing operation; and a developing bias setting part that sets a value of the developing bias in accordance with the remaining quantity calculated by the remaining quantity calculation part and the relationship stored in the deterioration grade storage part.

6 Claims, 7 Drawing Sheets

FIG. 3

| REMAINING QUANTITY (g) | 20 | 19 | 18 | 17 | 16 | 15 | 14 | 13 | 12 | 11 | 10 | 9 | 8 | 7 | 6 | 5 | 4 | 3 | 2 | 1 |
|---|---|---|---|---|---|---|---|---|---|---|---|---|---|---|---|---|---|---|---|---|
| DETERIORATION DEGREE | 1 | 2 | 3 | 4 | 5 | 6 | 7 | 8 | 9 | 10 | 11 | 12 | 13 | 14 | 15 | 16 | 17 | 18 | 19 | 20 |

22

FIG. 4

| | NUMBER OF SHEETS | 1 | 2 | 3 | 4 | 5 | 6 |
|---|---|---|---|---|---|---|---|
| NUMBER OF DOTS | PATTERN A | 1 | 1 | 1 | 5 | 5 | 5 |
| | PATTERN B | 5 | 5 | 5 | 1 | 1 | 1 |

FIG. 5

| REMAINING QUANTITY (g) | NUMBER OF SHEETS | 1 | 2 | 3 | 4 | 5 | 6 |
|---|---|---|---|---|---|---|---|
| | PATTERN A | 20→19 | 19→18 | 18→17 | 17→12 | 12→7 | 7→2 |
| | PATTERN B | 20→15 | 15→10 | 10→5 | 5→4 | 4→3 | 3→2 |

FIG. 6

| DETERIORATION DEGREE | NUMBER OF SHEETS | 1 | 2 | 3 | 4 | 5 | 6 |
|---|---|---|---|---|---|---|---|
| | PATTERN A | 1 | 2 | 3 | 4 | 9 | 14 |
| | PATTERN B | 1 | 6 | 11 | 16 | 17 | 18 |

FIG. 7

| DETERIORATION QUANTITY | NUMBER OF SHEETS | 1 | 2 | 3 | 4 | 5 | 6 |
|---|---|---|---|---|---|---|---|
| | PATTERN A | 1 | 3 | 6 | 10 | 19 | 33 |
| | PATTERN B | 1 | 7 | 18 | 34 | 51 | 69 |

FIG. 8

| DEVELOPING BIAS (V) | NUMBER OF SHEETS | 1 | 2 | 3 | 4 | 5 | 6 | 7 |
|---|---|---|---|---|---|---|---|---|
| | PATTERN A | 400 | 399 | 397 | 394 | 390 | 381 | 367 |
| | PATTERN B | 400 | 399 | 393 | 382 | 366 | 349 | 331 |

DEVELOPING BIAS SETTING IN AN IMAGE FORMING APPARATUS

CROSS-REFERENCE TO RELATED APPLICATIONS

This application claims priority from Japanese Patent Application No. 2008-334378 filed on Dec. 26, 2008, the entire subject matter of which is incorporated herein by reference.

TECHNICAL FIELD

Aspects of the invention relate to an image forming apparatus.

BACKGROUND

In an image forming apparatus that forms an image electrophotographically, a developing roller is provided opposite to a photosensitive drum. An electrostatic latent image is formed on a surface of the photosensitive drum. The developing housing accommodates toner. The developing roller is rotatably held in the developing housing. A developing bias is applied to the developing roller. When the photosensitive drum is rotated and an electrostatic latent image on the surface of a photosensitive drum opposes the developing roller, toner is supplied from the developing roller to the electrostatic latent image by means of a potential difference between the photosensitive drum and the developing roller. According thereto, the electrostatic latent image is developed into a toner image, and the toner image is formed on the photosensitive drum. The toner image is transferred to a sheet directly or by way of an intermediate transfer belt from the surface of the photosensitive drum.

However, when the toner image is formed in the number of times, the toner held on the developing roller may be deteriorated. For example, quantity of electric charge of the toner may be decreased. Thus, the quantity of toner transferred from the developing roller to the surface of the photosensitive drum may eventually vary, and density of a toner image formed on a sheet differs from an appropriate density. Therefore, the image forming apparatus corrects a value of the developing bias at appropriate timing in order to form a toner image at an appropriate density.

In order to correct the developing bias, a known correction processing utilizes a test toner image called a patch. In the known correction processing, for instance, a patch is experimentally formed on a surface of an intermediate transfer belt. Then, the density of the patch is measured, and the value of the developing bias is corrected such that a deviation between the measured density and a predetermined target density comes to zero.

SUMMARY

Illustrative aspects of the invention provide an image forming apparatus that can set a developing bias to an optimum value in a simple manner.

BRIEF DESCRIPTION OF THE DRAWINGS

FIG. 3 shows one example of a deterioration degree table;

FIG. 4 shows a number of dots of each image formed on each sheet when images are formed on six sheets in patterns A and B;

FIG. 5 shows a remaining quantity of developer before and after forming each image on the respective sheet when the images are formed on six sheets in the patterns A and B;

FIG. 6 shows a deterioration degree of the developer resulting from forming each image on the respective sheet when the images are formed on six sheets in the patterns A and B;

FIG. 7 shows a deterioration quantity of the developer after forming each image on the respective sheet when the images are formed on six sheets in the patterns A and B;

FIG. 8 shows a developing bias applied at the time of forming each image on the respective sheet when the images are formed on six sheets in the patterns A and B;

DETAILED DESCRIPTION

General Overview

Figure 1:
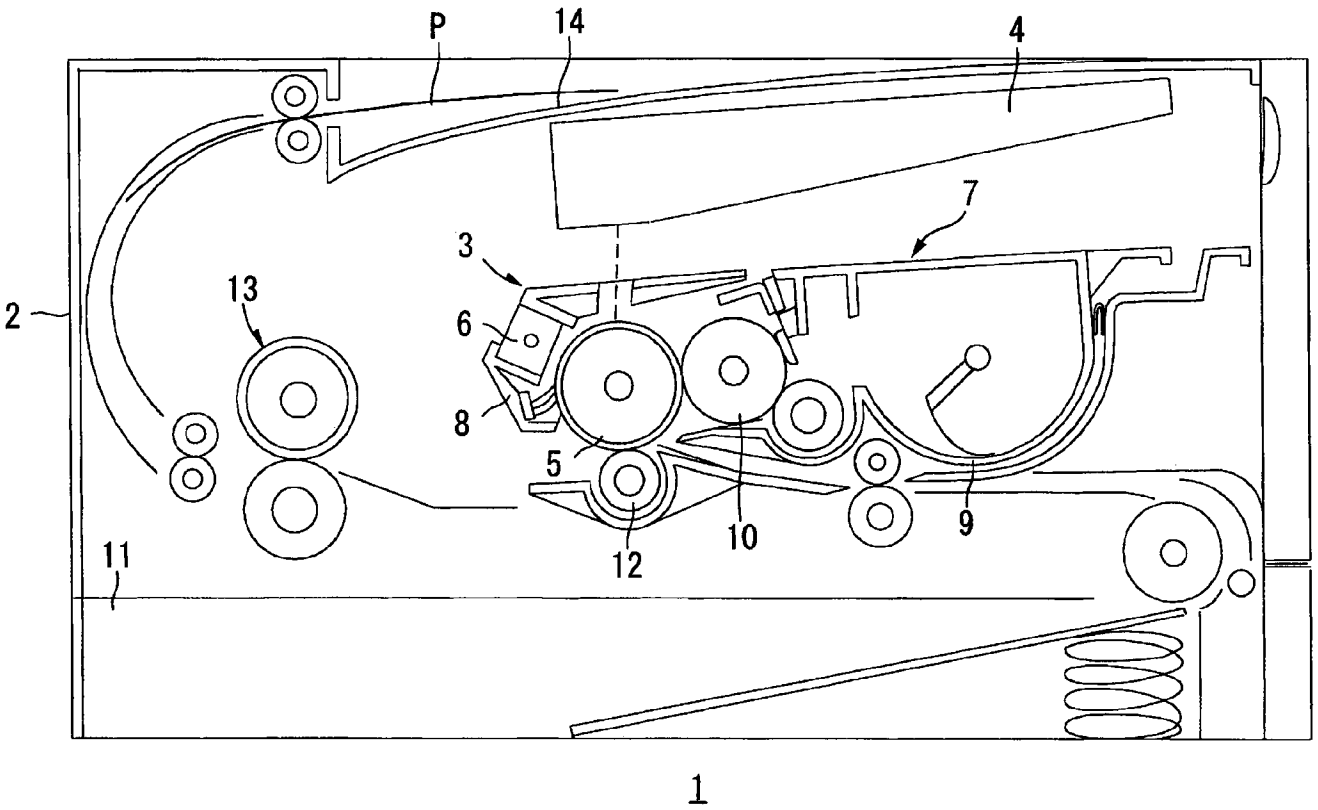
FIG. 1 is a side cross-sectional view of an image forming apparatus according to an exemplary embodiment of the invention.

In the known correction processing, when the developing bias is not corrected to an appropriate value by one processing (i.e., when the deviation between the density of the patch and the target density does not come to zero), it is required to execute the processing a plurality of times. Thus, time may be consumed for correcting the developing bias, and toner may be wasted due to repeated formation of the patch.

In order to avoid such a problem, some known image forming apparatus adopts a simple technique for monotonously decreasing the value of the developing bias with an increase in the number of rotations of the developing roller.

However, deterioration of toner does not proceed proportionally to an increase in the number of rotations of the developing roller. For this reason, it is difficult to set the developing bias to an optimum value by monotonously decreasing the value of the developing bias with an increase in the number of rotations of the developing roller. Thus, a toner image formed on the sheet may not have the appropriate density.

Therefore, illustrative aspects of the invention provide an image forming apparatus that can set a developing bias to an optimum value in a simple manner without utilizing patches.

According to a first illustrative aspect of the invention, there is provided an image forming apparatus, which executes a developing operation for forming a developer image, and which forms an image comprising the developer image on a recording medium, the image forming apparatus comprising: an image carrier, on which an electrostatic latent image is formed; a developing housing that accommodates a developer for developing the electrostatic latent image into a developer image; a developer carrier, which is held by the developing housing, which carries the developer in the developing housing, and which supplies the developer to the image carrier; a developing bias supply part that supplies a developing bias to the developer carrier; a remaining quantity calculation part that calculates a remaining quantity of the developer in the developing housing; a deterioration grade storage part that stores a relationship between the remaining quantity of the developer in the developing housing and a deterioration degree of the developer caused by the developing operation; and a developing bias setting part that sets a value of the developing bias in accordance with the remaining quantity calculated by the remaining quantity calculation part and the relationship stored in the deterioration grade storage part.

According thereto, the remaining quantity calculation part calculates the remaining quantity of developer in the developing housing. The deterioration grade storage part stores a relationship between the remaining quantity of the developer in the developing housing and the deterioration degree of the developer caused by developing operation. The developing bias setting part sets a value of a developing bias in accordance with the remaining quantity calculated by the remaining quantity calculation part and the relationship stored in the deterioration grade storage part.

The deterioration degree of the developer caused by one developing operation is dependent on the remaining quantity of the developer in the developing housing. Specifically, deterioration of the developer greatly progresses when developing operation is performed with a relatively-small remaining quantity of the developer than when developing operation is performed with a relatively-large remaining quantity of the developer in the developing housing. For this reason, deterioration quantity of the developer proceeded from its brand-new state is not directly proportional to the remaining quantity of the developer but increases in a reverse proportional manner with a decrease in the remaining quantity of the developer. Therefore, even when the value of the developing bias is monotonously decreased with a decrease in the remaining quantity of the developer, the developing bias cannot be set to an optimum value conforming to the deterioration quantity of the developer.

Figure 10:
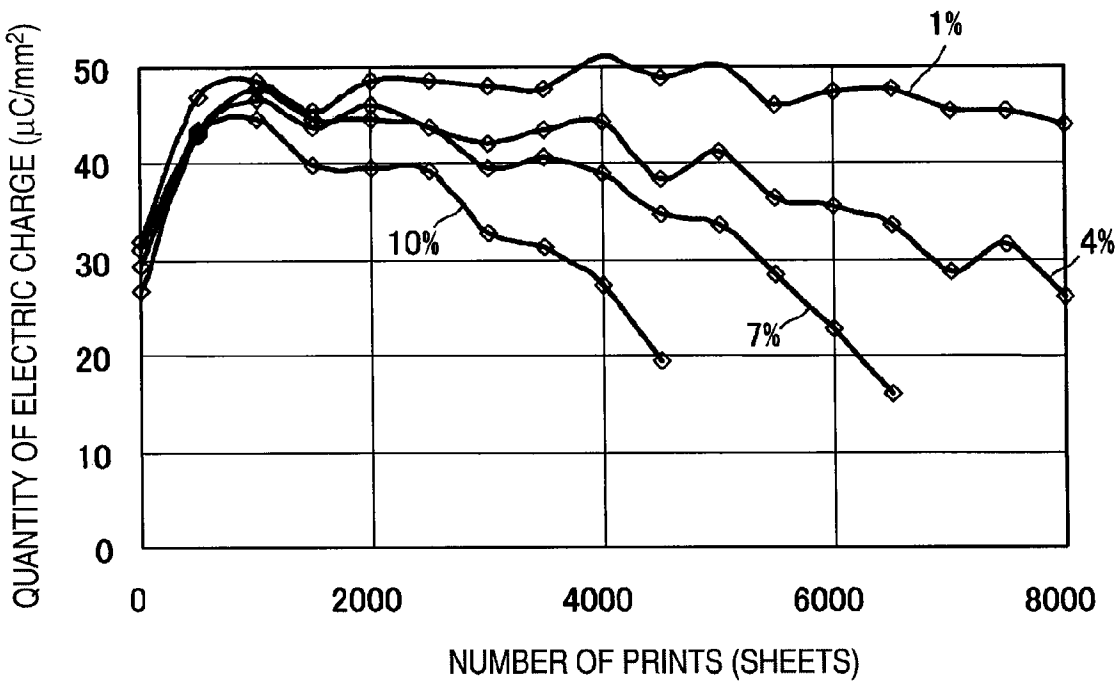
FIG. 10 is a graph showing a relationship between the number of prints (the number of sheets on each of which an image is formed) and a quantity of electric charge of the developer.

FIG. 10 is a graph showing a relationship between the number of prints (the number of sheets on which images are to be formed) and the quantity of electric charge of a developer.

Printing (image formation) was executed at 1%, 4%, 7%, and 10% print duty ratios, which is a ratio between an area of a printable region and an area of a print region (a color region), and the quantity of electric charge of the developer (toner) acquired at each of printing operations was studied. A graph shown in FIG. 10 shows results acquired at that time.

Even when printing was executed at any of 1%, 4%, 7%, and 10% print duty ratios, the quantity of electric charge of the developer substantially, monotonously increased from about 30 $\mu C/mm^2$ to about 45 $\mu C/mm^2$ in an initial stage (from 0 to about 500 sheets) along with an increase in the number of prints. Subsequently, when printing was executed at a 1% print duty ratio, the quantity of electric charge of the developer substantially unchanged at about 45 $\mu C/mm^2$ in spite of an increase in the number of prints. In contrast, when printing was executed at a 4% print duty ratio, the quantity of electric charge of the developer gradually decreased with an increase in the number of prints. When the $8000^{th}$ sheet was printed, the quantity of electric charge of the developer decreased to about 27 $\mu C/mm^2$. Further, when printing was executed at a 7% print duty ratio, the quantity of electric charge of the developer greatly decreased as compared with the quantity of electric charge achieved at a 4% print duty ratio. The quantity of electric charge of the developer decreased to about 16 $\mu C/mm^2$ at the time of printing of the $6500^{th}$ sheet. Moreover, when printing was executed at a 10% print duty ratio, the quantity of electric charge of the developer greatly decreased with an increase in the number of prints as compared with the case where printing was executed at a 7% print duty ratio. The quantity of electric charge of the developer decreased to about 20 $\mu C/mm^2$ or less at the time of printing of the $5000^{th}$ sheet.

The number of prints substantially corresponds to the quantity of toner consumption, and the quantity of electric charge of the developer corresponds to the deterioration quantity of the developer. Hence, from the graph shown in FIG. 10, it is understood that a change in the deterioration quantity of the developer changes according to a printing mode (a print duty ratio). Therefore, even when the value of the developing bias is monotonously decreased with a decrease in the remaining quantity of the developer, the developing bias cannot be set to an optimum value conforming to the deterioration quantity of the developer.

According to the first illustrative aspect of the invention, the deterioration grade storage part stores the relationship between the remaining quantity of the developer in the developing housing and the deterioration degree of the developer induced by the developing operation, it is possible to determine with superior accuracy, from the relationship, the deterioration degree of the developer induced by individual developing operation. The deterioration quantity of the developer in the developing housing proceeded from its brand-new state is determined from the determined deterioration degree. According thereto, it is possible to set the developing bias to an optimum value conforming to the deterioration quantity of the developer without utilization of patches. Accordingly, an image (i.e., a developer image) having appropriate density can be formed on a recording medium without regard to the deterioration quantity of the developer.

According to a second illustrative aspect of the invention, in the image forming apparatus, wherein the remaining quantity calculation part calculates the remaining quantity at each predetermined timing, and wherein the developing bias setting part sets the value of the developing bias every time the remaining quantity calculation part calculates the remaining quantity.

According thereto, the remaining quantity calculation part calculates, at each predetermined timing, the remaining quantity of the developer in the developing housing. Every time the remaining quantity is calculated, the developing bias setting part sets a value of a developing bias. Specifically, the developing bias is set to an optimum value conforming to the deterioration quantity of the developer at each predetermined timing. Therefore, the density of an image formed on a recording medium can continually be maintained at appropriate density.

According to a third illustrative aspect of the invention, in the image forming apparatus, wherein the remaining quantity calculation part calculates the remaining quantity in each developing operation.

According thereto, a developing bias is set to an appropriate value, which conforms to the deterioration quantity of the developer, in each developing operation. Therefore, the density of an image formed on a recording medium can continually be maintained at appropriate density with higher accuracy.

According to a fourth illustrative aspect of the invention, the image forming apparatus further comprises: a dot counter that counts the number of dots of the image formed on the recording medium, wherein the remaining quantity calculation part calculates the remaining quantity of the developer in the developing housing based on the number of dots counted by the dot counter.

According thereto, the image forming apparatus includes the dot counter that counts the number of dots of an image to be formed on a recording medium (i.e., the number of dots of an electrostatic latent image to be formed on an image carrier). The quantity of developer used in forming an image on a recording medium is substantially proportional to the number of dots of the image. Therefore, it is possible to calculate the quantity of developer used in forming the image by counting the number of dots of the image. The calculated quantity of developer is subtracted from the remaining quantity of the developer in the developing housing before forming the image. According thereto, it is possible to calculate the quantity of developer which will remain in the developing housing after forming the image.

According to a fifth illustrative aspect of the invention, the image forming apparatus further comprises: a deterioration quantity calculation part, which calculates the deterioration degree of the developer based on the relationship stored in the deterioration grade storage part, and which calculates a deterioration quantity of the developer by integrating the calculated deterioration degrees every time the remaining quantity calculation part calculates the remaining quantity of the developer, wherein the developing bias setting part sets the developing bias to a value corresponding to the deterioration quantity calculated by the deterioration quantity calculation part.

According thereto, every time the remaining quantity of the developer in the developing housing is calculated, the deterioration quantity calculation part determines the deterioration degree of the developer (i.e., deterioration quantity of the developer having proceeded since the deterioration degree of the developer was determined last time). The deterioration degrees of the developer are integrated, thereby determining the deterioration quantity of the developer proceeded from its brand-new state. Consequently, the developing bias can be set to an optimum value conforming to the deterioration quantity of the developer.

According to a sixth illustrative aspect of the invention, the image forming apparatus further comprises: a developing operation prohibition part that prohibits execution of subsequent developing operations when the deterioration quantity calculated by the deterioration quantity calculation part exceeds a threshold value.

According thereto, when the deterioration quantity of the developer in a developing housing surpasses a predetermined threshold value, subsequent developing operation is prohibited.

Before the deterioration quantity of the developer surpasses a predetermined threshold value, by setting a developing bias to an optimum value conforming to the deterioration quantity of the developer, the density of an image formed on a recording medium can be appropriately set. However, when the deterioration quantity of the developer surpasses the predetermined threshold value and when the developer becomes significantly deteriorated, it is no longer possible to form an image of appropriate density on a recording medium by only the adjustment of the developing bias. Worse yet, a phenomenon of so-called print fog resulting from adhesion of a developer to a white area (an area outside a print area where an image is to be formed) of a recoding medium may occur. In addition, when developing operation is performed while the developer is significantly deteriorated, the developer may leak from a developing housing.

When the deterioration quantity of the developer surpasses the predetermined threshold value, performance of subsequent developing operation is prohibited; hence, it is possible to prevent forming an image on a recording medium while the developer is significantly deteriorated. As a consequence, occurrence of print fog can be prevented. Leakage of the developer from the developing housing can be prevented too.

According to the first illustrative aspect, it is possible to set the developing bias to an optimum value conforming to the deterioration quantity of the developer without utilization of patches. As a consequence, an image of appropriate density (a developer image) can be formed on a recording medium without regard to the deterioration quantity of the developer.

According to the second and third illustrative aspects, the developing bias is set to an optimum value conforming to the deterioration quantity of the developer at each predetermined timing.

According to the fourth illustrative aspect, it is possible to calculate the quantity of developer used in forming the image by counting the number of dots of the image. By subtracting the calculated quantity of the developer from the remaining quantity of the developer in the developing housing before forming the image, it is possible to calculate the remaining quantity of the developer which will remain in the developing housing after forming the image.

According to the fifth illustrative aspect, the developing bias can be set to an optimum value conforming to the deterioration quantity of the developer.

According to the sixth illustrative aspect, occurrence of print fog can be prevented. Leakage of the developer from the developing housing can be prevented too.

Exemplary Embodiments

Exemplary embodiments of the invention will now be described with reference to the drawings.

(Image Forming Apparatus)

Referring to FIG. 1, an image forming apparatus 1 will be described.

The image forming apparatus 1 includes a body casing 2. A process cartridge 3 is removably placed at a substantially center in the body casing 2. An exposure unit 4 having a laser, and the like, is provided at a position above the process cartridge 3 within the body casing 2. Incidentally, a printer is one example of the image forming apparatus 1.

The process cartridge 3 includes a photosensitive drum 5 (one example of an image carrier), an electrifier 6 and a developing cartridge 7. A drum frame 8 holds the photosensitive drum 5 and the electrifier 6. The developing cartridge 7 includes a developing housing 9 for accommodating developer and a developing roller 10 (one example of a developer carrier) that is held by the developing housing 9. A portion of a peripheral surface of the developing roller 10 is exposed through the developing housing 9. The developing cartridge 7 is removably attached to the drum frame 8 in such a way that the portion of the peripheral surface of the developing roller 10 contacts a peripheral surface of the photosensitive drum 5.

In accordance with a rotation of the photosensitive drum 5, the surface of the photosensitive drum 5 is uniformly electrified by the electrifier 6. Subsequently, the surface of the photosensitive drum 5 is selectively exposed to a laser beam originating from the exposure unit 4 in accordance with image data received from a personal computer, and the like, connected to the image forming apparatus 1. Electric charges are selectively eliminated from the surface of the photosensitive drum 5 by means of exposure, whereupon an electrostatic latent image is formed on the surface of the photosensitive drum 5. A developing bias is applied to the developing roller 10. When the electrostatic latent image opposes the developing roller 10, developer is supplied from the developing roller 10 to the electrostatic latent image by means of a potential difference between the electrostatic latent image and the developing roller 10. Accordingly, a developer image is formed on the surface of the photosensitive drum 5 (one example of a developing operation). Incidentally, toner is one example of the developer.

A sheet feeding cassette 11 housing sheets P (one example of a recording medium) is placed at a bottom of the body casing 2. The sheets P are fed from a sheet feeding cassette 11 one at a time and fed to a space between the photosensitive drum 5 and a transfer roller 12 positioned opposite the photosensitive drum. When opposed the transfer roller 12, the developer image on the surface of the photosensitive drum 5 is transferred to the sheet p entered the space between the photosensitive drum 5 and the transfer roller 12.

A fixing unit 13 is disposed at a downstream position with reference to the process cartridge 3 in a direction of conveyance of the sheet P. The sheet P on which the developer image has been transferred is conveyed to the fixing unit 13. The developer image is fixed as an image on the sheet P in the fixing unit 13 by means of heating and pressurization. The sheet P, on which the image is formed, is discharged to a sheet discharge tray 14 on an upper surface of the body casing 2 by means of various rollers.

Figure 2:
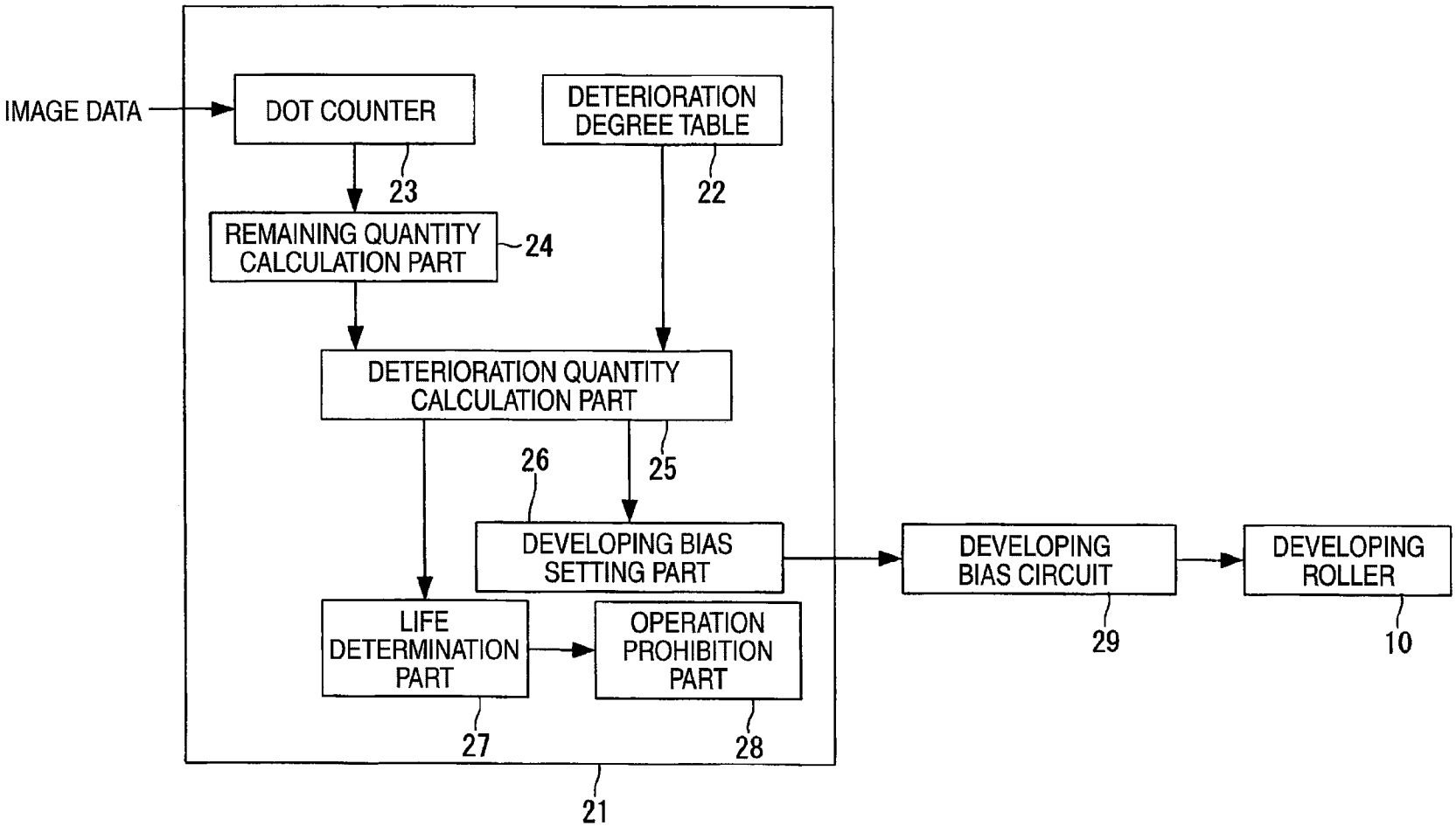
FIG. 2 is a block diagram of the image forming apparatus.

Referring to FIG. 2, an electrical configuration of the image forming apparatus 1 will be described.

The image forming apparatus 1 has a control part 21 for controlling respective parts. The control part 21 has, as a hardware configuration, a CPU, RAM, ROM, EEPROM, and the like. ROM stores a deterioration degree table 22 (one example of a deterioration degree storage part) that stores a relationship between the remaining quantity of the developer in the developing housing 9 and the deterioration degree of the developer induced by developing operation.

The image forming apparatus 1 substantially has, in the form of a configuration implemented in the manner of software by program processing of the CPU, a dot counter 23, a remaining quantity calculation part 24, a deterioration quantity calculation part 25, a developing bias setting part 26, a life determination part 27 and an operation prohibition part 28.

The dot counter 23 counts the number of dots making up an image to be formed on one sheet P. Specifically, when the image forming apparatus 1 receives image data from the outside, the image data are expanded into bitmap memory consisting of RAM. The dot counter 23 counts the number of color dots in the image data expanded in the bitmap memory.

The quantity of developer used to form an image on one sheet P (i.e., developer consumption quantity) is substantially proportional to the number of dots of the image. From the number of dots counted by the dot counter 23, the remaining quantity calculation part 24 calculates the quantity of developer consumed in forming an image on one sheet P. The remaining quantity calculation part 24 subtracts the calculated quantity of developer consumption from the remaining quantity of the developer in the developing housing 9 before forming an image and calculates the quantity of the developer which will remain in the developing housing 9 after forming an image. The remaining quantity of the developer in the developing housing 9 is stored in EEPROM provided in the control part 21.

Every time the remaining quantity of the developer is calculated by the remaining quantity calculation part 24, the deterioration quantity calculation part 25 determines the deterioration degree of the developer induced by developing operation for forming an image on one sheet P (i.e., induced by one rotation of the developing roller 10) by reference to the deterioration degree table 22. The deterioration quantity calculation part 25 integrates the determined deterioration degrees by use of the EEPROM and calculates the deterioration quantity of the developer in the developing housing 9 proceeded from its brand-new state (a value of integration of the deterioration degrees).

The developing bias setting part 26 sets the developing bias supplied to the developing roller 10 to a value corresponding to the deterioration quantity calculated by the deterioration quantity calculation part 25.

The life determination part 27 compares the deterioration quantity calculated by the deterioration quantity calculation part 25 with a threshold value. When the deterioration quantity has reached the threshold value, the life determination part 27 determines that the developing cartridge 7 has reached the end of its life at a point in time.

When the life determination part 27 determines that the developing cartridge 7 has reached the end of its life, the operation prohibition part 28 prohibits subsequent operation for forming an image including developing operation.

The image forming apparatus 1 is additionally provided with a developing bias circuit 29 (one example of a developing bias supply part) for supplying the developing roller 10 with a developing bias. The developing bias circuit 29 is controlled in accordance with a value of the developing bias set by the developing bias setting part 26. By means of control operation, the developing bias circuit 29 supplies the developing roller 10 with the developing bias of the value set by the developing bias setting part 26.

(Deterioration Degree Table)

Referring to FIG. 3, the deterioration degree table 22 will be described.

The deterioration degree table 22 stores a relationship between the remaining quantity of the developer in the developing housing 9 and the deterioration degree of the developer achieved when single developing operation is executed in each of remaining quantities of the developer. The relationship between the remaining quantities of the developer and the deterioration degrees is previously determined from results of various test conducted before shipment of the image forming apparatus 1.

As shown in FIG. 3, in the exemplary embodiment, the deterioration degree of the developer is determined when single developing operation is executed in each remaining quantity of the developer from 20 g to 1 g at intervals of one gram. According to the deterioration degree table 22 shown in FIG. 3, when an image is formed on one sheet P while 17 grams of developer are left in the developing housing 9, the developer in the developing housing 9 gets worse by a value of four.

(Developing Bias Setting Processing)

Referring to FIGS. 3 to 8, processing for setting a developing bias (developing bias setting processing) will be described. Hereinafter, it is assumed that images are formed on six sheets P in each of patterns A and B while 20 grams of developer are left in the developing housing 9. Forming a one-dot image involves consumption of one gram of developer.

FIG. 4 is a view showing the number of dots of the image formed on each of sheets achieved when an image is formed on each of six sheets in each of the patterns A and B.

As shown in FIG. 4, in the case of the pattern A, a one-dot image is formed on each of the first to third sheets P, and a five-dots image is formed on each of the fourth to sixth sheets P.

In the case of the pattern B, a five-dots image is formed on each of the first to third sheets P, and a one-dot image is formed on each of the fourth to sixth sheets P.

(1) Pattern A

Explanations are first given to a case where an image is formed in the pattern A on six sheets P.

(1.1) When an image is formed on the first sheet P, the developing bias setting part 26 sets a developing bias to a value corresponds to its deterioration quantity by reference to deterioration quantities stored in the EEPROM. Since the deterioration quantity achieved at this time is zero, a value of a developing bias is set to 400V as shown in FIG. 8. Then, as shown in FIG. 4, one-dot image is formed on the sheet P. One gram of developer is consumed by forming the one-dot image. As shown in FIG. 5, the remaining quantity calculation part 24 subtracts one gram from 20 grams that are the remaining quantity of the developer in the developing housing 9 before forming the image and calculates 19 grams as the remaining quantity of the developer in the developing housing 9 after forming the image. Subsequently, the deterioration quantity calculation part 25 determines the deterioration degree of the developer resulting from forming the image on the first sheet P by reference to the deterioration degree table 22 shown in FIG. 3. Here, since the image was formed while 20 grams of developer were left, the deterioration degree of the developer achieved at this time is determined to be "one" as shown in FIG. 6. A deterioration degree of "one" is stored as a deterioration quantity in the EEPROM as shown in FIG. 7.

(1.2) Since the deterioration quantity assumes a value of "one" at the time of forming an image on the second sheet P, the developing bias setting part 26 sets the value of the developing bias to 399 V as shown in FIG. 8. Then, as shown in FIG. 4, one-dot image is formed on the sheet P. One gram of developer is consumed as a result of forming the one-dot image. As shown in FIG. 5, the remaining quantity calculation part 24 subtracts one gram from 19 grams that are the remaining quantity of the developer in the developing housing 9 before forming the image and calculates 18 grams that will be the remaining quantity of the developer in the developing housing 9 after forming the image. Subsequently, by reference to the deterioration degree table 22, the deterioration quantity calculation part 25 determines the deterioration degree of the developer resulting from forming the image on the second sheet P. Here, since the image was formed while 19 grams of developer were left, the deterioration degree of the developer achieved at this time is determined as "two," as shown in FIG. 6. A deterioration degree of "two" is added to the deterioration quantity of "one" stored in the EEPROM. According thereto, the deterioration quantity of the developer comes to "three," as shown in FIG. 7.

(1.3) When an image is formed on the third sheet P, the deterioration quantity is "three." Therefore, as shown in FIG. 8, the developing bias setting part 26 sets the value of the developing bias to 397V. Then, as shown in FIG. 4, one-dot image is formed on the sheet P. One gram of developer is consumed by forming the one-dot image. As shown in FIG. 5, the remaining quantity calculation part 24 subtracts one grain from 18 grams that are the remaining quantity of the developer in the developing housing 9 before forming the image and calculates 17 grams that will be the remaining quantity of the developer in the developing housing 9 after forming the image. Subsequently, the deterioration quantity calculation part 25 makes a reference to the deterioration degree table 22 and determines the deterioration degree of the developer resulting from forming the image on the third sheet P. Here, since the image was formed while 18 grams of developer were left, the deterioration degree of the developer achieved at this time is determined to be "three," as shown in FIG. 6. A deterioration degree of "three" is added to the deterioration quantity of "three" stored in the EEPROM. According thereto, the deterioration quantity of the developer comes to "six," as shown in FIG. 7.

(1.4) When an image is formed on the fourth sheet P, the deterioration quantity is "six." Therefore, as shown in FIG. 8, the developing bias setting part 26 sets the value of the developing bias to 394V. Then, as shown in FIG. 4, five-dots image is formed on the sheet P. Five grams of developer are consumed by forming the five-dots image. As shown in FIG. 5, the remaining quantity calculation part 24 subtracts five grams from 17 grams that are the remaining quantity of the developer in the developing housing 9 before forming the image and calculates 12 grams that will be the remaining quantity of the developer in the developing housing 9 after forming the image. Subsequently, the deterioration quantity calculation part 25 makes a reference to the deterioration degree table 22 and determines the deterioration degree of the developer resulting from forming the image on the fourth sheet P. Here, since the image was formed while 17 grams of developer were left, the deterioration degree of the developer achieved at this time is determined to be "four," as shown in FIG. 6. A deterioration degree of "four" is added to the deterioration quantity of "six" stored in the EEPROM. According thereto, the deterioration quantity of the developer comes to "10," as shown in FIG. 7.

(1.5) When an image is formed on the fifth sheet P, the deterioration quantity is "10." Therefore, as shown in FIG. 8, the developing bias setting part 26 sets the value of the developing bias to 390V. Then, as shown in FIG. 4, five-dots image is formed on the sheet P. Five grams of developer are consumed by forming the five-dots image. As shown in FIG. 5, the remaining quantity calculation part 24 subtracts five grams from 12 grams that are the remaining quantity of the developer in the developing housing 9 before forming the image and calculates seven grams that will be the remaining quantity of the developer in the developing housing 9 after forming the image. Subsequently, the deterioration quantity calculation part 25 makes a reference to the deterioration degree table 22 and determines the deterioration degree of the developer resulting from forming the image on the fifth sheet P. Here, since the image was formed while 12 grams of developer were left, the deterioration degree of the developer achieved at this time is determined to be "nine," as shown in FIG. 6. A deterioration degree of "nine" is added to the deterioration quantity of "10" stored in the EEPROM. According thereto, the deterioration quantity of the developer comes to "19," as shown in FIG. 7.

(1.6) When an image is formed on the sixth sheet P, the deterioration quantity is "19." Therefore, as shown in FIG. 8, the developing bias setting part 26 sets the value of the developing bias to 381V. Then, as shown in FIG. 4, five-dots image is formed on the sheet P. Five grams of developer are consumed by forming the five-dots image. As shown in FIG. 5, the remaining quantity calculation part 24 subtracts five grams from seven grams that are the remaining quantity of the developer in the developing housing 9 before forming the image and calculates two grams that will be the remaining quantity of the developer in the developing housing 9 after forming the image. Subsequently, the deterioration quantity calculation part 25 makes a reference to the deterioration degree table 22 and determines the deterioration degree of the developer resulting from forming the image on the sixth sheet P. Here, since the image was formed while seven grams of developer were left, the deterioration degree of the developer achieved at this time is determined to be "14," as shown in FIG. 6. A deterioration degree of "14" is added to the deterioration quantity of "19" stored in the EEPROM. According thereto, the deterioration quantity of the developer comes to "33," as shown in FIG. 7.

When an image is formed on the seventh sheet P, the deterioration quantity is "33." Therefore, as shown in FIG. 8, the developing bias setting part 26 sets the value of the developing bias to 367V.

(2) Pattern B

Explanations are first given to a case where an image is formed in the pattern B on six sheets P.

(2.1) When an image is formed on the first sheet P, since the deterioration quantity stored in the EEPROM is zero, the developing bias setting part 26 sets the value of a developing bias to 400V as shown in FIG. 8. Then, as shown in FIG. 4, five-dots image is formed on the sheet P. Five grams of developer are consumed by forming the five-dots image. As shown in FIG. 5, the remaining quantity calculation part 24 subtracts five grams from 20 grams that are the remaining quantity of the developer in the developing housing 9 before forming the image and calculates 15 grams as the remaining quantity of the developer in the developing housing 9 after forming the image. Subsequently, the deterioration quantity calculation part 25 determines the deterioration degree of the developer resulting from forming the image on the first sheet P by reference to the deterioration degree table 22. Here, since the image was formed while 20 grams of developer were left, the deterioration degree of the developer achieved at this time is determined to be "one" as shown in FIG. 6. A deterioration degree of "one" is stored as the deterioration quantity in the EEPROM as shown in FIG. 7.

(2.2) Since the deterioration quantity assumes a value of "one" at the time of forming the image on the second sheet P, the developing bias setting part 26 sets the value of the developing bias to 399 V as shown in FIG. 8. Then, as shown in FIG. 4, five-dots image is formed on the sheet P. Five grams of developer are consumed as a result of forming the five-dots image. As shown in FIG. 5, the remaining quantity calculation part 24 subtracts five grams from 15 grams that are the remaining quantity of the developer in the developing housing 9 before forming the image and calculates 10 grams that will be the remaining quantity of the developer in the developing housing 9 after forming the image. Subsequently, by reference to the deterioration degree table 22, the deterioration quantity calculation part 25 determines the deterioration degree of the developer resulting from forming the image on the second sheet P. Here, since the image was formed while 15 grams of developer were left, the deterioration degree of the developer achieved at this time is determined as "six," as shown in FIG. 6. A deterioration degree of "six" is added to the deterioration quantity of "one" stored in the EEPROM. According thereto, the deterioration quantity of the developer comes to "seven," as shown in FIG. 7.

(2.3) When an image is formed on the third sheet P, the deterioration quantity is "seven." Therefore, as shown in FIG. 8, the developing bias setting part 26 sets the value of the developing bias to 393V. Then, as shown in FIG. 4, five-dots image is formed on the sheet P. Five grams of developer are consumed by forming the five-dots image. As shown in FIG. 5, the remaining quantity calculation part 24 subtracts five grams from 10 grams that are the remaining quantity of the developer in the developing housing 9 before forming the image and calculates five grams that will be the remaining quantity of the developer in the developing housing 9 after forming the image. Subsequently, the deterioration quantity calculation part 25 makes a reference to the deterioration degree table 22 and determines the deterioration degree of the developer resulting from forming the image on the third sheet P. Here, since the image was formed while 10 grams of developer were left, the deterioration degree of the developer achieved at this time is determined to be "11," as shown in FIG. 6. A deterioration degree of "11" is added to the deterioration quantity of "seven" stored in the EEPROM. According thereto, the deterioration quantity of the developer comes to "18," as shown in FIG. 7.

(2.4) When an image is formed on the fourth sheet P, the deterioration quantity is "18." Therefore, as shown in FIG. 8, the developing bias setting part 26 sets the value of the developing bias to 382V. Then, as shown in FIG. 4, one-dot image is formed on the sheet P. One gram of developer is consumed by forming the one-dot image. As shown in FIG. 5, the remaining quantity calculation part 24 subtracts one gram from five grams that are the remaining quantity of the developer in the developing housing 9 before forming the image and calculates four grams that will be the remaining quantity of the developer in the developing housing 9 after forming the image. Subsequently, the deterioration quantity calculation part 25 makes a reference to the deterioration degree table 22 and determines the deterioration degree of the developer resulting from forming the image on the fourth sheet P. Here, since the image was formed while five grams of developer were left, the deterioration degree of the developer achieved at this time is determined to be "16," as shown in FIG. 6. A deterioration degree of "16" is added to the deterioration quantity of "18" stored in the EEPROM. According thereto, the deterioration quantity of the developer comes to "34," as shown in FIG. 7.

(2.5) When an image is formed on the fifth sheet P, the deterioration quantity is "34." Therefore, as shown in FIG. 8, the developing bias setting part 26 sets the value of the developing bias to 366V. Then, as shown in FIG. 4, one-dot image is formed on the sheet P. One gram of developer is consumed by forming the one-dot image. As shown in FIG. 5, the remaining quantity calculation part 24 subtracts one gram from four grams that are the remaining quantity of the developer in the developing housing 9 before forming the image and calculates three grams that will be the remaining quantity of the developer in the developing housing 9 after forming the image. Subsequently, the deterioration quantity calculation part 25 makes a reference to the deterioration degree table 22 and determines the deterioration degree of the developer resulting from forming the image on the fifth sheet P. Here, since the image was formed while four grams of developer were left, the deterioration degree of the developer achieved at this time is determined to be "17," as shown in FIG. 6. A deterioration degree of "17" is added to the deterioration quantity of "34" stored in the EEPROM. According thereto, the deterioration quantity of the developer comes to "51," as shown in FIG. 7.

(2.6) When an image is formed on the sixth sheet P, the deterioration quantity is "51." Therefore, as shown in FIG. 8, the developing bias setting part 26 sets the value of the developing bias to 349V. Then, as shown in FIG. 4, one-dot image is formed on the sheet P. One gram of developer is consumed by forming the one-dot image. As shown in FIG. 5, the remaining quantity calculation part 24 subtracts one gram from three grams that are the remaining quantity of the developer in the developing housing 9 before forming the image and calculates two grams that will be the remaining quantity of the developer in the developing housing 9 after forming the image. Subsequently, the deterioration quantity calculation part 25 makes a reference to the deterioration degree table 22 and determines the deterioration degree of the developer resulting from forming the image on the sixth sheet P. Here, since the image was formed while three grams of developer were left, the deterioration degree of the developer achieved at this time is determined to be "18," as shown in FIG. 6. A deterioration degree of "18" is added to the deterioration quantity of "51" stored in the EEPROM. According thereto, the deterioration quantity of the developer comes to "69," as shown in FIG. 7.

When an image is formed on the seventh sheet P, the deterioration quantity is "69." Therefore, as shown in FIG. 8, the developing bias setting part 26 sets the value of the developing bias to 331V.

As can be seen from the comparison between the case where the image was formed in the pattern A on each of the six sheets P and the case where the image was formed in the pattern B on each of the six sheets P, even when the same quantity of developer remains after forming the images on the respective six sheets P, the same deterioration quantity of the developer does not always occur after forming the images on the respective six sheets P. Therefore, even when the value of the developing bias is monotonously decreased with an increase in the number of images formed (the number of rotations of the developing roller 10), the developing bias cannot be set to an appropriate value. Therefore, a developer image of appropriate density cannot be formed on the sheet P.

In the image forming apparatus 1, the relationship between the remaining quantity of the developer in the developing housing 9 and the deterioration degree of the developer induced by developing operation is stored in the deterioration degree table 22. Hence, the deterioration degree of the developer induced by developing operation can be determined with high accuracy in accordance with the relationship. From the determined deterioration degree, by calculating the deterioration quantity of developer in the developing housing 9 proceeded from its brand-new state, the developing bias can be set to an optimum value corresponding to the deterioration quantity of the developer without utilization of patches.

Specifically, the dot counter 23 counts the number of dots of an image to be formed on the sheet P. The remaining quantity calculation part 24 calculates from the number of dots the quantity of developer which will be used in forming an image. The calculated quantity of developer is subtracted from the remaining quantity of the developer in the developing housing 9 before forming the image and calculates the quantity of developer which will remain in the developing housing 9 after forming the image. Every time the remaining quantity of the developer in the developing housing 9 is calculated, the deterioration quantity calculation part 25 determines the deterioration degree of the developer (i.e., the deterioration quantity of the developer having progressed since the deterioration degree of the developer was determined last time). Thus, the determined deterioration degrees of developer are integrated, and the deterioration quantity of the developer progressed from its brand-new state is determined. The developing bias setting part 26 sets the developing bias to an optimum value corresponding to the deterioration quantity of the developer.

According thereto, an image (developer image) of appropriate density can be formed on the sheet P regardless of the deterioration quantity of the developer.

Every time an image is formed on one sheet P; namely, in one developing operation, the image forming apparatus 1 sets the developing bias to an optimum value corresponding to the deterioration quantity of the developer. Therefore, the density of an image to be formed on the sheet P can continually be maintained at an appropriate density level with superior accuracy.

The value of the developing bias may also be set every time images are formed on a predetermined number (a plurality of) of sheets P. In this case, a burden of the control part 21 (CPU) can be lessened.

(Life Determination Processing)

Figure 9:
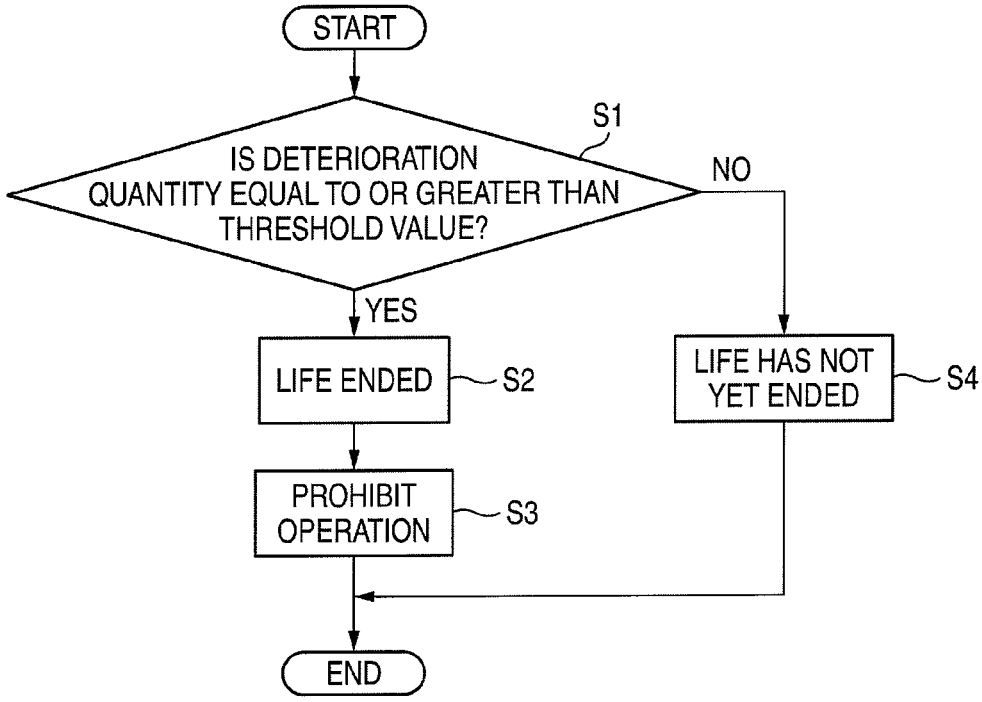
FIG. 9 is a flowchart of life determination processing.

Referring to FIG. 9, a life determination processing will be described.

In response to the deterioration quantity of the developer being calculated by the deterioration quantity calculation part 25 shown in FIG. 2, the life determination part 27 and the operation prohibition part 28 shown in FIG. 2 execute the life determination processing.

During life determination processing, the life determination part 27 determines whether or not the deterioration quantity of the developer is a threshold value or more (S1).

When the deterioration quantity is a threshold value or more (YES in S1), the developing cartridge 7 is determined to have reached the end of its life (S2). In this case, the operation prohibition part 28 prohibits execution of all subsequent operations for forming an image including developing operation (S3).

If the deterioration quantity is less than the threshold value (NO in S1), the developing cartridge 7 is determined to have not yet reached the end of its life (S4), and life determination processing is completed.

Before the deterioration quantity of the developer surpasses the threshold value, the density of an image to be formed on the sheet P can be made appropriate by setting the developing bias to an optimum value corresponding to the deterioration quantity of the developer. However, when the deterioration quantity of the developer surpasses the threshold value and when the developer becomes significantly deteriorated, an image of appropriate density cannot be formed on the sheet P by mere adjustment of the developing bias. Worse yet, a phenomenon of so-called print fog resulting from adhesion of developer to a white area (an area outside a print area where an image is to be formed) of the sheet P may occur. In addition, when developing operation is executed while developer is significantly deteriorated, developer may leak from a developing housing 9.

Since the deterioration quantity calculation part 25 calculates the deterioration quantity of the developer with superior accuracy, the image forming apparatus 1 can determine with high precision, from the deterioration quantity, whether or not the developing cartridge 7 has reached the end of its life.

When the deterioration quantity of the developer surpasses the threshold value, subsequent developing operation is prohibited. Hence, it is possible to prevent forming the image on the sheet P while the developer becomes considerably deteriorated. According thereto, occurrence of a print fog can be prevented. Leakage of developer from the developing housing 9 can also be prevented.

Modification to Exemplary Embodiments

The invention can also be applied to a color printer as well as to a monochrome printer. The color printer is provided with the photosensitive drum 5 and the developing roller 10 for each of black, yellow, magenta, and cyan colors. Therefore, it is better to provide the deterioration degree table 22 for each color; to calculate the deterioration degree and deterioration quantity of the developer from the respective tables; and to set the developing bias to a value corresponding to the calculated deterioration quantity. In such a case, the deterioration degree tables for respective colors may also be identical with each other or may differ from each other according to properties of respective colors of toner.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. An image forming apparatus, configured to execute a developing operation for forming a developer image and to form an image comprising the developer image on a recording medium, the image forming apparatus comprising:

an image carrier configured to carry an electrostatic latent image formed thereon;

a developing housing configured to accommodate a developer for developing the electrostatic latent image into a developer image;

a developer carrier, which is held by the developing housing, and which is configured to carry the developer in the developing housing and to supply the developer to the image carrier;

a developing bias supply part configured to supply a developing bias to the developer carrier;

a remaining quantity calculation part configured to calculate a remaining quantity of the developer in the developing housing;

a deterioration degree storage part configured to store a relationship between the remaining quantity of the developer in the developing housing and a deterioration degree of the developer caused by each of a series of developing operations;

a deterioration quantity calculation part configured to, every time the remaining quantity calculation part calculates the remaining quantity of the developer:

determine the deterioration degree of the developer based on the relationship stored in the deterioration degree storage part, and calculate a deterioration quantity of the developer by adding each of the determined deterioration degrees; and a developing bias setting part configured to set a value of the developing bias corresponding to the deterioration quantity calculated by the deterioration quantity calculation part, wherein the deterioration degree of the developer is a value previously stored in the deterioration degree storage part in relation to the remaining quantity of the developer in the developing housing, and wherein the developing bias supply part is configured to supply the developing bias set by the developing bias setting part to the developer carrier.

2. The image forming apparatus according to claim 1, wherein the remaining quantity calculation part is configured to calculate the remaining quantity at each of a plurality of predetermined times, and wherein the developing bias setting part is configured to set the value of the developing bias every time the remaining quantity calculation part calculates the remaining quantity.

3. The image forming apparatus according to claim 2, wherein the remaining quantity calculation part is configured to calculate the remaining quantity in each of the developing operations.

4. The image forming apparatus according to claim 1, further comprising:

a dot counter configured to count the number of dots of the image formed on the recording medium, wherein the remaining quantity calculation part is configured to calculate the remaining quantity of the developer in the developing housing based on the number of dots counted by the dot counter.

5. The image forming apparatus according to claim 1, further comprising:

a developing operation prohibition part configured to prohibit execution of subsequent developing operations when the deterioration quantity calculated by the deterioration quantity calculation part exceeds a threshold value.

6. An image forming apparatus comprising:

an image carrier configured to carry an electrostatic latent image formed thereon;

a developing housing configured to accommodate a developer for developing the electrostatic latent image into a developer image;

a developer carrier, held by the developing housing, and configured to carry the developer in the developing housing and to supply the developer to the image carrier;

a developing bias supply part configured to supply a developing bias to the developer carrier;

a processing unit; and memory storing computer readable instructions that, when executed, cause the performance of operations including:

calculating a remaining quantity of the developer in the developing housing;

storing, in a deterioration degree storage part, a relationship between the remaining quantity of the developer in the developing housing and a deterioration degree of the developer caused by each of a series of developing operations;

each time the remaining quantity of the developer is calculated:

determining the deterioration degree of the developer based on the relationship stored in the deterioration degree storage part, and calculating a deterioration quantity of the developer by adding each of the determined deterioration degrees; and setting a value of the developing bias corresponding to the calculated deterioration quantity, wherein the deterioration degree of the developer is a value previously stored in the deterioration degree storage part in relation to the remaining quantity of the developer in the developing housing, and wherein the developing bias supply part is configured to supply the set developing bias value to the developer carrier.

* * * * *